US006816126B2

(12) United States Patent
Yasukawa et al.

(10) Patent No.: US 6,816,126 B2
(45) Date of Patent: Nov. 9, 2004

(54) HELICAL ANTENNA AND HELICAL ANTENNA ARRAY

(75) Inventors: Masataka Yasukawa, Nishinomiya (JP); Akio Funae, Nishinomiya (JP); Koji Yano, Nishinomiya (JP)

(73) Assignee: Furuno Electric Company Ltd., Hyogo-ken (JP)

( * ) Notice: Subject to any disclaimer, the term of this patent is extended or adjusted under 35 U.S.C. 154(b) by 0 days.

(21) Appl. No.: 10/201,253

(22) Filed: Jul. 24, 2002

(65) Prior Publication Data

US 2003/0020669 A1 Jan. 30, 2003

(30) Foreign Application Priority Data

Jul. 25, 2001 (JP) ..... 2001-224593

(51) Int. Cl.[7] ..... H01Q 1/36

(52) U.S. Cl. ..... 343/895; 343/778; 343/844; 343/853

(58) Field of Search ..... 343/771, 776, 343/778, 895, 853, 893, 844

(56) References Cited

U.S. PATENT DOCUMENTS 4,680,591 A * 7/1987 Axford et al. ..... 343/853
5,329,287 A 7/1994 Strickland ..... 343/782
5,539,421 A * 7/1996 Hong ..... 343/895
5,831,582 A * 11/1998 Muhlhauser et al. ..... 343/753

FOREIGN PATENT DOCUMENTS

GB 2202380 A 9/1988
JP 4-358404 A 12/1992

* cited by examiner

*Primary Examiner*—Shih-Chao Chen

(74) *Attorney, Agent, or Firm*—Birch, Stewart, Kolasch & Birch, LLP

(57) ABSTRACT

A small and light helical antenna, with a high gain, includes arranging the dielectric cylinder with a helix conductor on the conductive plate and arranging a thin rectangular conductive plate between the lower end of the helix conductor and the feed point in a predetermined position of the conductive plate. The impedance matching is between the input impedance of the helix conductor and a power feeder. The upper and lower conductive plates constitute parallel plate waveguide space, and the probe which comes into the parallel plate waveguide space is in the lower conductive plate side, and the lower end of a thin rectangular conductive plate is connected with the lower end of a probe.

10 Claims, 8 Drawing Sheets

(A)

(B)

(A)

(B)

(A)

(B)

CONVENTIONAL ART

HELICAL ANTENNA AND HELICAL ANTENNA ARRAY

FIELD OF THE INVENTION

This invention relates to antennas, and more particularly to helical-type antennas and arrays thereof.

BACKGROUND OF THE INVENTION

Parabolic reflector antennas are widely used for INMARSAT A and B.

The specifications of INMARSAT A and B require the frequency range between 1.525 and 1.6465 GHz, 20 dBi or higher gain, and the axial ratio of 2 dB or less. But the caliber of parabolic reflector antenna is as large as about 85–90 cm, and its pedestal (plinth) is also heavy to satisfy these requirements.

Furthermore, an antenna efficiency of a parabolic reflector antenna is generally about 70%, and it's been desired to develop the efficient antenna which can be miniaturized.

Then, a helical antenna has been developed as shown in the following patent and patent applications: (1) Japanese Patent Publication No. 8-2005, (2) Provisional Publication No. 7-235829, and (3) Provisional Publication No. 5-259734. These antennas are made to supply electric power through a waveguide by arranging helix conductors which are longer than a wavelength.

With these helical antennas, it's possible to obtain a circularly polarized wave with a good axial ratio as radiation wave to the direction of an axis of a helix by defining a pitch angle and a length of a helix. Moreoever, the gain is increased and simultaneously, the axial ratio is also improved by increasing the number of helix turns and with a longer helix length.

SUMMARY OF THE INVENTION

However, the size of a helix in the axis direction becomes long and the size of antenna becomes large as the whole, if the number of turns of helix conductor of each element antenna is to increase, for improvement in a gain and an axial ratio. Therefore, the number of turns of helix is restricted naturally.

For example, the theoretical gain of the helical antenna with 1.5 turns is 7–8 dBi and an axial ratio will be 3 dB or more On the other hand, the input impedance of helix is as much as or more than 100 ohms, and a matching circuit is required in order to connect with the power feeder of 50-ohm system.

For example, in the helical antenna as shown in FIG. 8, the dielectric cylinder 1 with a helix conductor 2 is arranged on the conductive plate 3, the matching circuit 4 is formed on the conductive plate 3, and electric power is supplied through this matching circuit 4.

This matching circuit consists of a γg/4 adjustment circuit which is constituted from a micro strip line, and an adjustment circuit using the spatial combination with a metal plate and the ground.

However, with the structure which establishes such an adjustment circuit in the exterior of an element antenna, it is difficult to adjust the power feeding phase to each element antenna, when a helical antenna array is constituted.

In short, the pattern of the whole power feeding circuit including the matching circuit becomes complicated, since it is necessary to change the position of a matching circuit according to the position of an element antenna, even though element antennas are arranged so that the power feeding phases are the same.

Consequently, it is also difficult to miniaturize the whole helical antenna array.

Moreover, in the helical antenna array shown in the above-mentioned official report (1), (2), and (3), there are problems that:

it is hard to fix a probe certainly;

it is not possible to measure the characteristic by a probe;

it is hard to set the impedance matching with helix conductor; since it is made to insert the joint part (probe) of helix conductor (coil) into waveguide from the front of an conductive plate.

Moreover, it is required to use the thick pair of upper and lower conductive plates constituting a waveguide in order to acquire the stable characteristic with the structure of power feeding through waveguide.

Then, there occurs a problem that the weight increases and its pedestal also becomes heavy for the reason, as shown in each above-mentioned official report.

Furthermore, it is impossible to raise a gain without increasing the size and weight of the whole antenna, since it is required to increase the number of element antennas and the area of an conductive plate in order to obtain a predetermined gain with the helical antenna array shown in the above-mentioned official reports.

The object of this invention is to constitute a helical antenna and a helical antenna array which is small and light with a height gain.

[Explanation of a mark]

Figure 1:
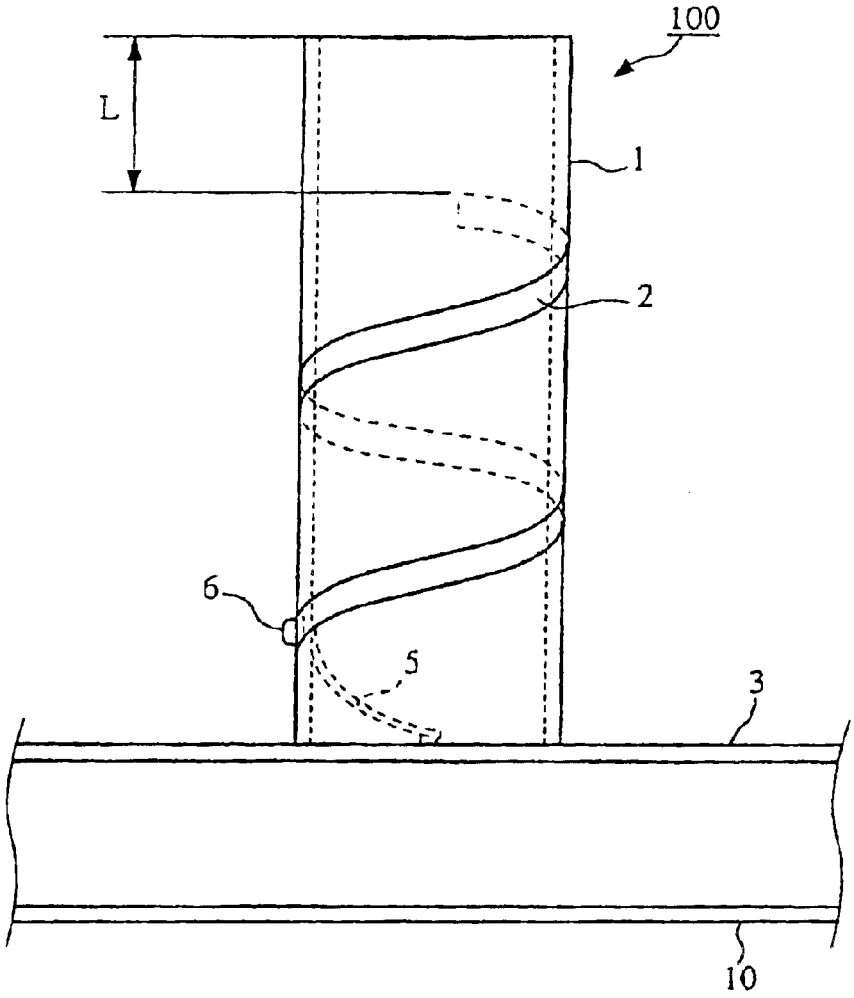
FIG. 1 shows the structure of a helical element antenna.
Figure 1:
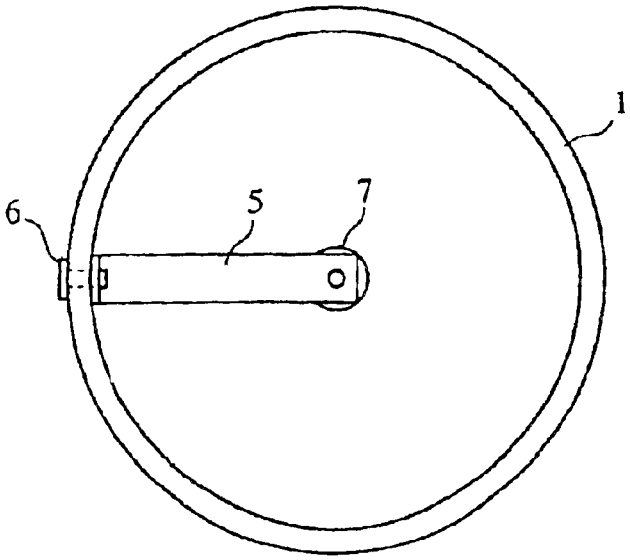

1: dielectric cylinder
2: helix conductor
3: conductive plate (upper conductive plate)
4: matching circuit
5: a thin rectangular conductive plate
6: conductive plate stopper
7: feeding point connection implement
8: probe
9: probe supporter
10: lower conductive plate
11: conductive material cover
12: screw
13: screw
14: probe
15: probe supporter
16: coaxial connector

17: circular conductive plate
18: sheet material
19: conductive material projection part
20: dielectric cylinder fixing implement
21: screw
100: helical element antenna

DETAILED DESCRIPTION OF THE PREFERED EMBODIMENTS OF THE INVENTION

FIG. 1 shows the structure of a helical element antenna.

FIG. 1(A) shows the side view, and FIG. 1(B) shows the elevational view looking at the direction of an axis of helix conductor.

In FIG. 1, 1 is a dielectric cylinder which consists of resin molding objects of polycarbonate with a 68 mm of an outer diameter and 150 mm of height here.

2 is helix conductor with 1.688 turns of the metal tape with a width of 5 mm along the perimeter side of the dielectric cylinder 1.

The pitch angle is 12.8 degrees.

3 is an conductive plate perpendicular to the axis of helix conductor 2, and uses the thin aluminum plate.

10 is a lower conductive plate parallel to the conductive plate 3, is constituted from a thin aluminum plate like the upper conductive plate 3, and constitutes parallel plate waveguide space from a pair of upper and lower conductive plates.

5 is a thin rectangular conductive plate.

Its one end is connected the end to the lower end of helix conductor 2 with the conductive plate stopper 6, and the other end is connected to the feed point which is the predetermined position of the conductive plate 3.

In (B) of FIG. 1, 7 is a feed point connector to connect with the feed point.

The lower end of helix conductor 2 is located in predetermined height from the lower end of the dielectric cylinder 1, and a thin rectangular conductive plate 5 is incurvated so that an interval with an conductive plate may approach gradually from the height to the height of the conductive plate 3.

This thin rectangular conductive plate 5 and the conductive plate 3 which is a grounding board constitute the distribution constant track.

The width of a thin rectangular plate 5 is fixed, and the electrostatic capacity produced between the conductive plates 3 increases gradually toward the feed point from the lower end of helix conductor 2.

With this structure, the impedance adjustment is done between the input impedance of a helix conductor, which is comparatively high as much as 100 ohms, and an power feeder (50-ohm probe mentioned later).

The upper end of the dielectric cylinder 1 is only L higher than the upper end of helix conductor 2. L is 47 mm here.

According to the embodiments, it improves the gain as much as 0.1–0.2 dBi with this structure.

It is guessed that this effect is what is depended on an action like the dielectric lens of the projection portion of the dielectric cylinder 1.

The lower end of a thin rectangular conductive plate 5 is on the center axis of the dielectric cylinder 1, and can be rotated as much as arbitrary angle with the rotating center of the helix conductor 2 center axis, i.e., the center axis of the dielectric cylinder 1.

Thus, it is not necessary to establish the circuit for impedance adjustment in the exterior of a dielectric cylinder, since the adjustment circuit is established in the inside of a dielectric cylinder.

Therefore, the flexibility in designing increases about the arrangement relation of an adjoining helical element antenna, in case of constituting a helical antenna aray by arranging plural dielectric cylinders 1 with a helix conductor as a helical element antenna.

In short, in case of feeding the electric power to each helical element antenna with arranging plural helical element antennas 100, it becomes possible to set up the power feeding phase to each helical element antenna only according to the rotation angle of the dielectric cylinder 1 with this invention, while the positions of the feed point differ for every helical element antenna, if an adjustment circuit is prepared outside like before.

Figure 2:
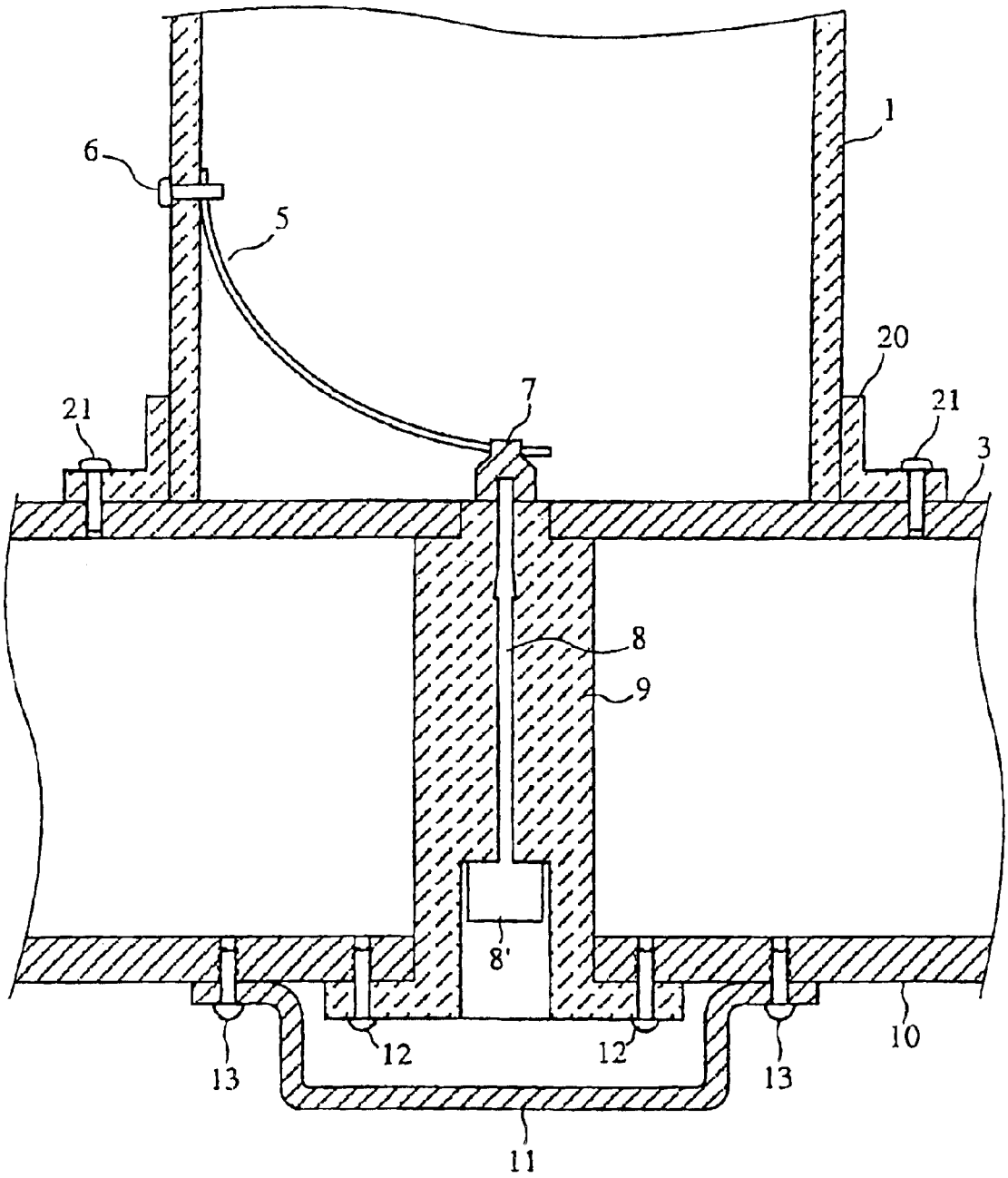
FIG. 2 shows the structure of the power feeder of this helical element antenna.

FIG. 2 is a sectional view showing the structure of the power feeder to the helical element antenna shown in FIG. 1.

In FIG. 2, the fixing implement 20 for defining the attachment position of the dielectric cylinder 1 is attached in the upper surface of the upper conductive plate 3 on the screw 21.

This dielectric cylinder fixing implement 20 is circular and its inner diameter is almost the same with the outer diameter of the dielectric cylinder 1.

The dielectric cylinder 1 is put into this dielectric cylinder fixing implement 20.

9 is a probe supporter made from, for example, PTFE material.

The pin-shape probe 8 is inserted into the center of this probe, supporter 9.

The probe supporter 9 equipped with the probe 8 is inserted from the lower part of the lower conductive plate 10, and is attached in the lower conductive plate 10 with the screw 12.

The tip part of the probe supporter 9 is inserted in the hole prepared in the upper conductive plate 3, and the tip of a probe 8 is inserted into the predetermined quantity projection in the upper part from the upper conductive plate 3.

And the feed point connector 7 is connected to the tip part of a probe 8 by soldering.

As mentioned above, the lower end of a thin rectangular conductive plate 5 is soldered to the feed point connector 7.

In addition, it can be connected through conductive line instead of a thin rectangular conductive plate.

Since the probe 8 is not strongly fixed to the probe supporter 9, and since the probe supporter 9 is PTFE material, a probe 8 rotates easily.

A probe 8 will rotate in connection with it, if the dielectric cylinder 1 is rotated on the condition that the lower end of a thin rectangular conductive plate 5 is fixed at the tip of a probe 8 through the feed point connector 7.

Thus, if the dielectric cylinder 1 is rotated, the phase of the radiation wave from a helical element antenna will change.

This is equivalent to the fact that the power feeding phase to a helix conductor is changed.

That is, adjustment of the rotation angle position of a dielectric cylinder can adjust a power feeding phase.

After adjusting the power feeding phase, the dielectric cylinder 1 does not rotate by vibration or shock and its position is held even though it is not adhered onto the dielectric cylinder fixing implement 20, since the dielectric cylinder 1 is fixed to the dielectric cylinder fixing implement 20 comparatively strongly.

As 8' shows, the lower end of a probe 8 has the different cylinder with a larger diameter.

With this structure, while defining the depth of pressing fit to the probe supporter 9, impedance adjustment with parallel plate waveguide space and a probe is taken.

Thus, the probe supporter 9 is inserted from the lower conductive plate 10 side, and since it fixed, a probe can be made to hold independently certainly in parallel plate waveguide space apart from attachment of a helical element antenna.

And since the head of the screw for probe attachment does not appear in the upper surface side of the upper conductive plate 3, it becomes easy to take matching with an antenna.

Moreover, in the state of the probe itself before attaching a helical element antenna, the probe of a measuring instrument is attached at the tip of a probe 8, and it also becomes possible to measure the characteristic.

11 is an conductive material cover covering an aperture of the lower conductive plate 10 prepared in order to attach the probe supporter 9.

With this structure, the continuity of the conductive plate of parallel plate waveguide space is kept.

However, there is almost no change on the electric characteristic, and especially if it is not necessary to protect a probe 8 and the probe supporter 9, it is not necessary to prepare.

Figure 3:
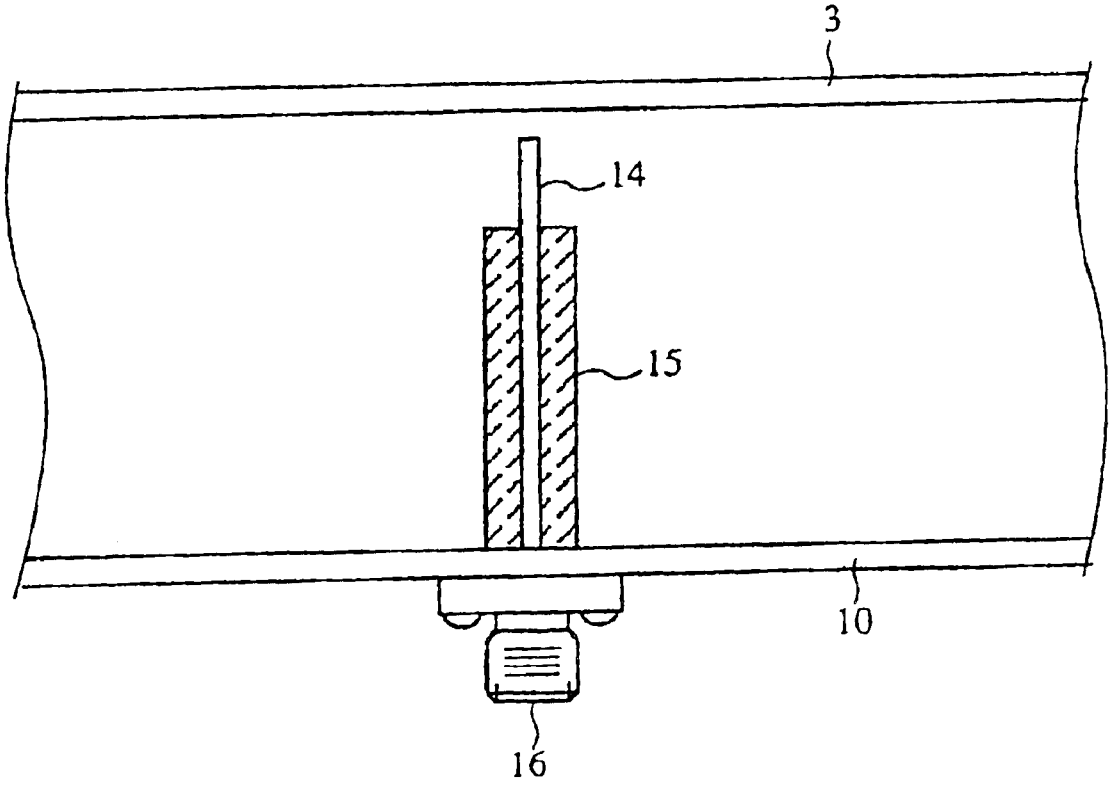
FIG. 3 shows the structure of the power feeder to a helical antenna array.

FIG. 3 is a sectional view showing the structure of the power feeder to a helical antenna array.

Here, 14 is a probe and 15 is the probe supporter to hold 14.

16 is a coaxial connector for input and output of an antenna signal.

The probe 14 is connected to the center of the conductor of this coaxial connector 16.

This probe 14 is arranged in the central part of parallel plate waveguide space inserted by the circular vertical conductive plates 3 and 10 as mentioned later.

Therefore, a signal spreads through parallel plate waveguide space between the probe 8 of each helical element antenna shown in FIG. 2, and this probe 14.

Figure 4:
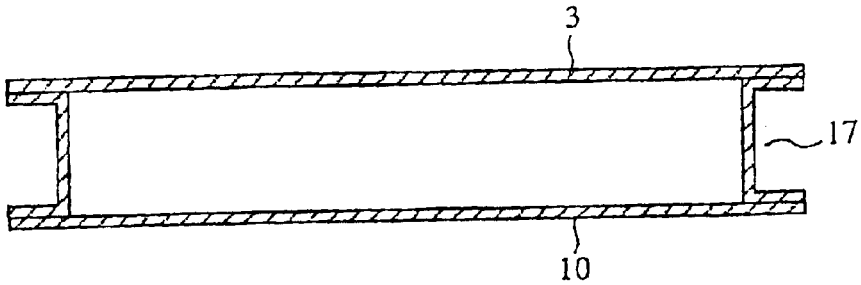
FIG. 4 is the sectional view showing the structure of parallel plate waveguide space.
Figure 4:
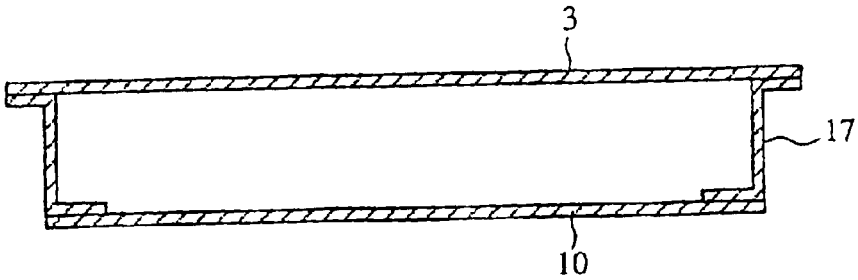
Figure 4:
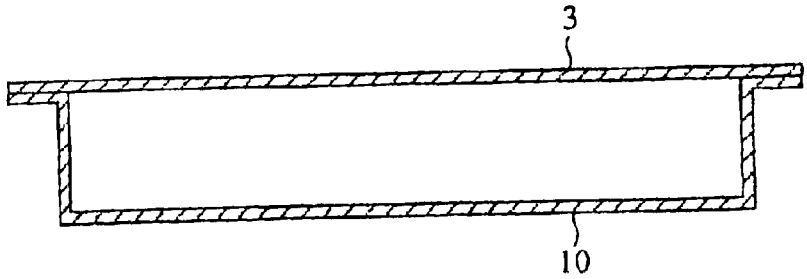

FIG. 4 is a sectional view showing the structure of three types of the above-mentioned parallel plate waveguide space.

However, the probe and helical element antenna of an power feeder which are mentioned above here are omitted.

In the example shown in FIG. 4(A), the circumference part of the upper conductive plate 3 and the lower conductive plate 10 facing each other is joined through cross-sectional ㅋ (Japanese) character type circular conductive plate 17.

This circular conductive plate 17 and the upper and lower conductive plates 3 and 10 are joined by spot welding, the rivet stop, or the screw stop.

The space surrounded by the upper and lower conductive plates 3 and 10 and circular conductive plate 17 constitutes parallel plate waveguide space.

In the example shown in FIG. 4(B), the upper and lower conductive plates 3 and 10 are joined through cross-sectional crank type circular conductive plate 17.

Furthermore, in the example shown in FIG. 4(C), the circumference part of the lower conductive plate 10 is made crooked, and the flange portion is joined to the circumference part of the upper conductive plate 3.

Figure 5:
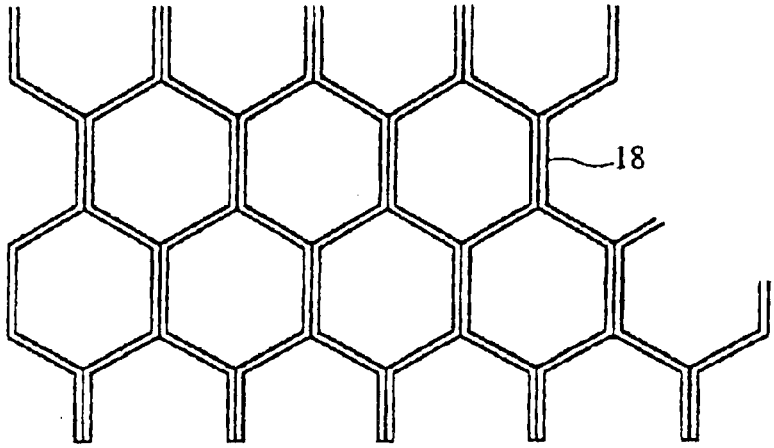
FIG. 5 shows the composition in parallel plate waveguide space.
Figure 5:
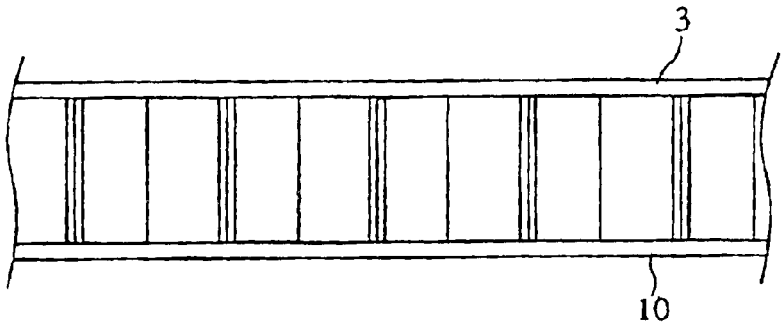

FIG. 5 shows the structure of the dielectric of the honeycomb structure established in parallel plate waveguide space shown in FIG. 4.

FIG. 5(A) shows the plane view of a honeycomb structure, and FIG. 5(B) shows the side view of a honeycomb structure which is arranged in a parallel plate waveguide space.

Here, 18 is the plural thin rectangular sheet material which consists of thick paper and thick sheet-like resin comparatively.

The structure is constructed by pasting up these sheet material in the predetermined parts of the sheet material which adjoins mutually, and extending them in the thickness direction of sheet material.

The inside of the upper and lower conductive plates 3 and 10 and the vertical side of a honeycomb structure are joined with adhesives.

Thus, the whole rigidity can be raised and its weight can be kept light, even though it is designed to make the thickness size of the upper and lower conductive plates 3 and 10 thin by establishing a honeycomb structure in a parallel plate waveguide space.

In addition, it is also possible to enclose foaming materials, such as for example, foaming styrene and styrene foam, with the space between the upper and lower conductive plates 3 and 10 instead of the above-mentioned honeycomb structure.

Figure 6:
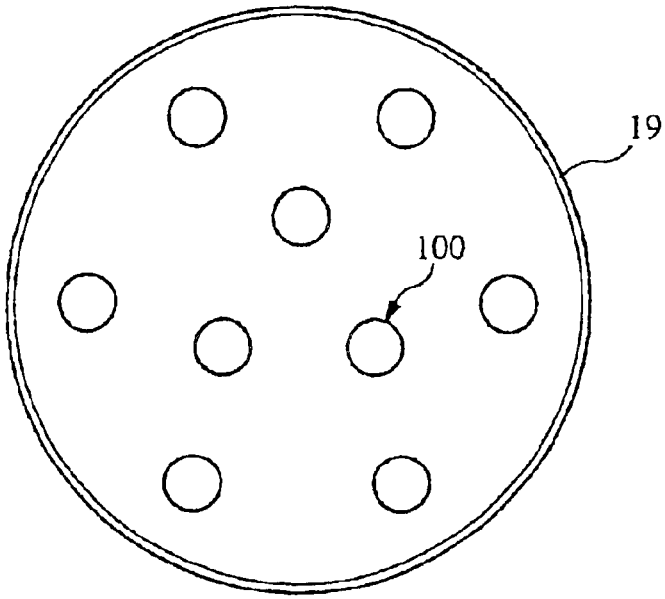
FIG. 6 shows the structure of the whole helical antenna array.
Figure 6:
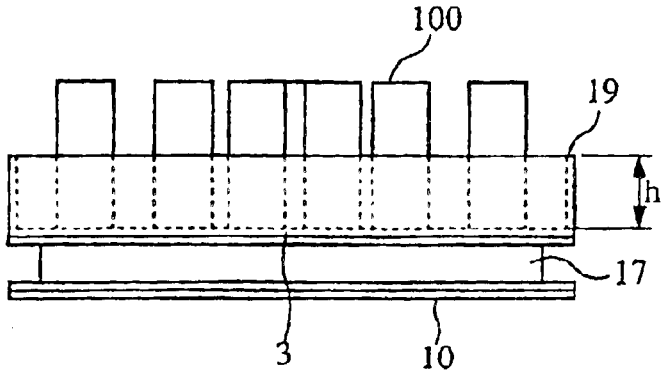

FIG. 6 shows the structure of the structure of upper and lower conductive plates, and the whole helical antenna array.

FIG. 6(A) is an elevational view and FIG. 6(B) is a side view.

In the upper surface of the upper conductive plate 3, plural helical element antennas 100 are arranged.

The circumference part of the upper conductive plate 3 is bent as much as "h" in the direction of the front, and it forms the conductive material projection part 19 for it.

Thus, curving and extending the circumference part of an upper conductive plate in the direction of the front is equivalent to expanding the area of an conductive plate so that a gain can be raised without physically extending an antenna aperture.

Figure 7:
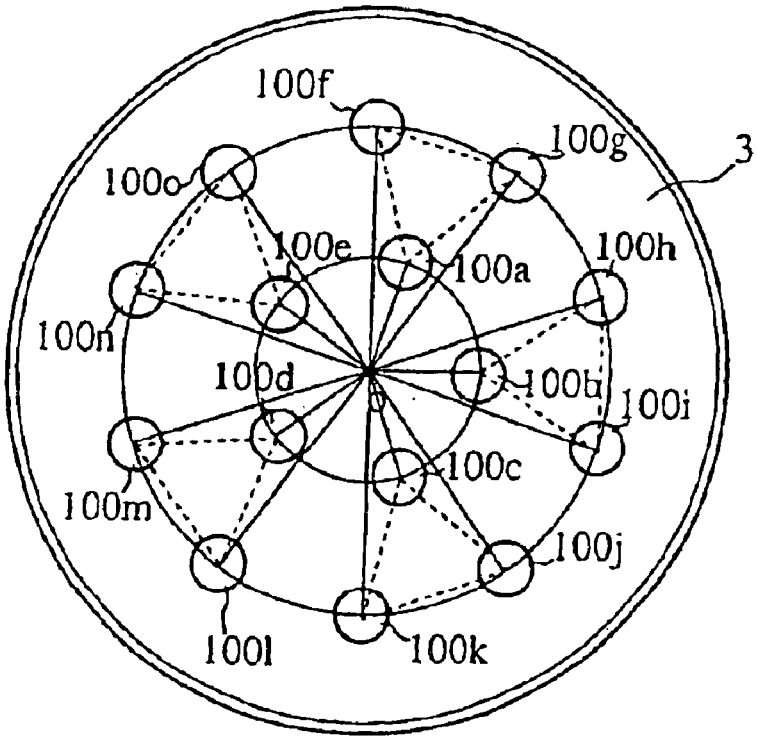
FIG. 7 shows the example of arrangement of plural helical element antennas.
Figure 7:
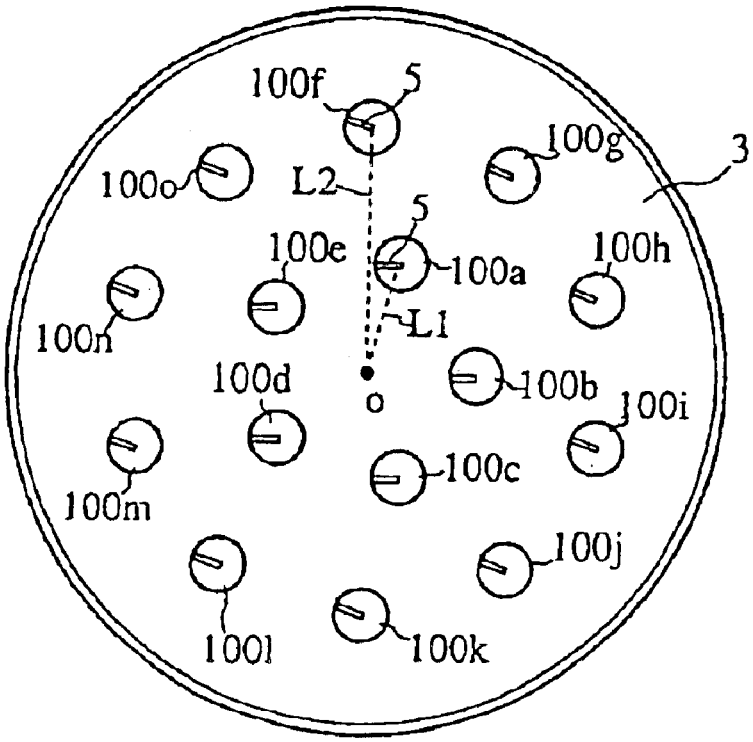
Figure 8:
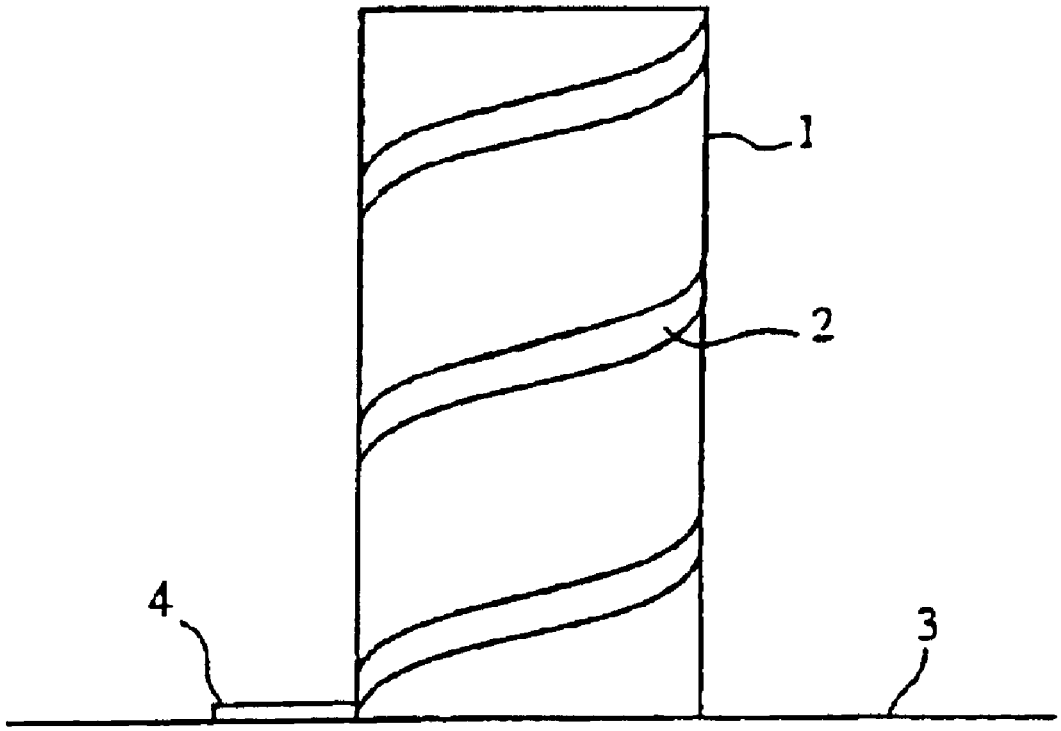
FIG. 8 shows the structure of the conventional helical antenna.

For example, there can be enabled 0.3 dBdi improvement of the gain and 5% or more improvement of the antenna efficiency when the circumference part of the conductive plate with the diameter of 70 cm is bent as much as 40 mm in the direction of the front, FIG. 7 is a figure showing the example of arrangement of the helical element antennas arranged on an upper conductive plate, FIG. 7(A) shows the position relation of each helical element antenna, and (B) shows the rotation position relation of each helical element antenna.

As shown in FIG. 7(A), the helical element antenna is arranged on the circle of two concentric circles, an inner circumference and the perimeter.

In this example, five are arranged to the inner circumference and ten helical element antennas are arranged on the perimeter.

Helical element antennas 100*a*–100*e* on an inner circumference are arranged with the same angle interval with the center "o".

Therefore, the angle interval is 360/5=72 degrees.

Moreover, helical element antennas 100*f*–100*o* on the perimeter are also arranged with the same angle interval with the center "o".

Therefore, the angle interval is 360/10=36 degrees.

Moreover, each center of helical element antennas 100*a*–100*e* on an inner circumference is made into the vertex, and three helical element antennas are arranged in the shape of an isosceles triangle so that it may become two angle positions of a base about the center of two helical element antennas which adjoin among helical element antenna 100*f*–100*o* on the perimeter.

The dashed line in a figure shows the isosceles triangle consisted of these three helical element antennas.

By such an arrangement, the length of the propagation on the parallel plate waveguide space from the center o which is the feed point of an antenna array to the feed points of each helical element antennas 100*a*–100*e* on an inner circumference become equal.

Moreover, with the helical element antennas 100*f*–100*o* of the perimeter, the length of the propagation from the center o to the feed points of helical element antennas 100*f*–100*o* become equal.

And the influence by the power feeding probes to helical element antennas 100*a*–100*e*, which are located near the propagation path, become equal.

Therefore, the characteristic of an power feeding path over the helical element antennas on the perimeter become equal, and it is also possible to feed the power to the helical element antennas with the same phase and the same amplitude.

As shown in FIG. 7(B), direction of a thin rectangular conductive plate 5 is the same, since the helical element antennas 100*a*–100*e* on an inner circumference has the same path length L1 from center o.

Similarly, the direction of a thin rectangular conductive plate 5 is the same, since the helical element antennas 100*f*–100*o* on perimeter has the same path length L2 from center o.

In this example, it is required to rotate the helical element antennas 100*f*–100*o* on the perimeter 340 degrees into the helix turn direction against the helical element antenna 100*a*–100*e* on an inner circumference, so that it may become equal to the phase of the electric wave emitted from helical element antennas 100*a*–100*e* on an inner circumference, since there is phase difference of 340 degrees between L1 and L2, In short, it is rotated 340 degrees leftward (this means 20 degrees to the right).

The radius of the inner circumference and the perimeter is set so that the contiguity interval of helical element antenna 100*a*–100*e* of an inner circumference and the contiguity interval of helical element antenna 100*f*–100*o* of the perimeter become almost equal.

Consequently, it is possible to make the interval of all helical element antennas almost equal, and to suppress the influence by interference of the nearby helical element antennas.

Moreover, the mutual interference of adjoining helical element antennas itself is reduced by lessening the number of turns of helix conductor with 1.688 turns.

Moreover, by making the interval between the centers of a helical element antenna into one or less wave of operating frequency, a grating lobe is lost and the improvement effect in a gain by array-izing is heightened.

By the above composition, high interest gain of 20 or more dBis of gains is obtained by the apperture with a diameter of 70 cm.

Moreover, even if the number of turns of helix conductor is a 1.688 turn grade, it continued for 1.525 to 1.6465 GHz, and the axial ratio has satisfied the characteristic of 2 dB or less.

Furthermore, what is 10 kg in the parabolic antenna is able to reduce to 3 kg in the equivalent antenna characteristic conventionally.

What is claimed is:

1. A helical antenna array equipped with a dielectric cylinder of a plurality of dielectric cylinders with a helix conductor approximately located at a surface of the dielectric cylinder, and an upper conductive plate perpendicular to the axis of the dielectric cylinder, comprising:

a lower end of the helix conductor is located at a predetermined distance from the upper conductive plate; and, a thin rectangular conductive plate, extending to the upper conductive plate gradually to a feed point located about the center of the dielectric cylinder, wherein the thin rectangular conductive plate is rotatable at an angle about the axis of the dielectric cylinder to adjust a power feeding path to the dielectric cylinder to be about equal to the plurality of dielectric cylinders.

2. The helical antenna array according to claim 1, wherein the dielectric cylinder is arranged at a predetermined height higher than the upper end of the helix conductor.

3. The helical antenna array, comprising:

the plurality of dielectric cylinders including the dielectric cylinder, according to claim 1 or 2, on the upper conductive plate as helical element antennas.

4. The helical antenna array according to claim 3, comprising:

a parallel plate waveguide space constituted from the upper conductive plate, and a lower conductive plate facing the upper conductive plate, and plural probes, in the parallel plate waveguide space, whose tips work as a plurality of feed points, attached to the lower conductive plate.

5. The helical antenna array according to claim 3, wherein dielectric material of foaming structure is set between the upper and lower conductive plates.

6. The helical antenna array according to claim 3, comprising:

a circular conductive plate projection which is the predetermined length higher than the upper conductive plate.

7. A helical antenna array according to claim 3, comprising:

wherein said upper conductive plate is a circular upper conductive plate paired with a circular lower conductive plate, and a group of 3 helical element antennas from the plurality of dielectric cylinders arranged in the shape of an isosceles triangle, and helical element antennas of the vertex position of the isosceles triangle are arranged at the same angle interval on a first concentric circle on the upper conductive plate, and two of the helical element antennas of the outer vertex position of the isosceles triangles are also arranged at the same angle interval on a second concentric circle on the upper conductive plate.

8. The helical antenna array according to claim 3, wherein a honeycomb structure is set between the upper and lower conductive plates.

9. A helical antenna array, the array including a plurality of dielectric cylinders, comprising:

an upper circular conductive plate;

a group of helical antennas from the plurality of dielectric cylinders arranged as an isosceles triangle, wherein each antenna has a helix conductor at the surface of the antenna with a lower end of the helix conductor at a predetermined distance from the upper circular conductive plate;

a first concentric circle on the upper circular conductive plate comprising at least one helical antenna of the helical antennas of the isosceles triangle rotatably arranged at an angle interval on the first concentric circle; and a second concentric circle on the upper circular conductive plate comprising two of the helical antennas of an outer vertex position of the isosceles triangle rotatably arranged at the angle interval on the second concentric circle.

10. The helical antenna array of claim 9, wherein the angle interval is determined by a rotatable position of a thin rectangular conductive plate approaching the upper conductive plate from the lower end of the helix conductor to a fixed point on the upper circular conductive plate.

* * * * *